US009973843B2

(12) United States Patent
Petersén

(10) Patent No.: US 9,973,843 B2
(45) Date of Patent: May 15, 2018

(54) EAR GEAR WITH EARPIECES INTERCONNECTED THROUGH HEADBAND WITH TWO LEGS

(71) Applicant: Zound Industries International AB, Stockholm (SE)

(72) Inventor: Erik Petersén, Nacka (SE)

(73) Assignee: Zound Industries International AB, Stockholm (SE)

( * ) Notice: Subject to any disclaimer, the term of this patent is extended or adjusted under 35 U.S.C. 154(b) by 0 days. days.

(21) Appl. No.: 15/502,911

(22) PCT Filed: Jun. 25, 2015

(86) PCT No.: PCT/SE2015/050741
§ 371 (c)(1),
(2) Date: Feb. 9, 2017

(87) PCT Pub. No.: WO2016/024896
PCT Pub. Date: Feb. 18, 2016

(65) Prior Publication Data

US 2017/0230745 A1 Aug. 10, 2017

(30) Foreign Application Priority Data

Aug. 15, 2014 (SE) ..... 1450952

(51) Int. Cl.
*H04R 1/10* (2006.01)

(52) U.S. Cl.
CPC ..... *H04R 1/1066* (2013.01); *H04R 1/105* (2013.01); *H04R 1/1008* (2013.01); *H04R 1/1033* (2013.01)

(58) Field of Classification Search
CPC combination set(s) only.
See application file for complete search history.

(56) References Cited

U.S. PATENT DOCUMENTS 2,237,752 A 4/1941 Clarke
2,518,035 A 8/1950 MacPheat
(Continued)

FOREIGN PATENT DOCUMENTS

GB 467435 A 6/1937
JP S53 1922 U 2/1978
WO WO 2010151191 A1 12/2010

*Primary Examiner* — Amir Etesam
(74) *Attorney, Agent, or Firm* — Knobbe Martens Olson & Bear LLP

(57) ABSTRACT

The present invention relates to ear gear (100; 200), such as headphones, headset, ear protection or similar, having a pair of earpieces (102, 103; 203), being attached generally to a respective end region (106, 107; 206, 207) of an interconnecting headband (108; 208). Each earpiece is adjustably associated with the headband, for adjustment of the position of the earpieces relative to the headband. The ear gear further comprises at least two extending legs (106A, 106B, 107A, 107B; 206A, 206B, 207A, 207B) provided at the end region (106, 107; 206, 207) at the headband, and arm members (110, 111; 211) that at one end (110A, 111A; 211A) are attached to a respective earpiece. Further, the ear gear comprises an end cap (110E, 111E; 211E) provided at the respective headband end region (106, 107; 206, 207). At least one of the extended legs is rotatably arranged to each end cap (110E, 111E; 211E), such that the end cap can rotate relative to the at least one leg (106A, 106B, 107A, 107B; 206A, 206B, 207A, 207B).

9 Claims, 8 Drawing Sheets

(56) References Cited

U.S. PATENT DOCUMENTS

| | | | | |
|---|---|---|---|---|
| 3,796,841 | A | 3/1974 | Gorman | |
| 2003/0079275 | A1 | 5/2003 | Woo et al. | |
| 2013/0322676 | A1* | 12/2013 | Araki ..... | H04R 1/1041<br>381/374 |

* cited by examiner

EAR GEAR WITH EARPIECES INTERCONNECTED THROUGH HEADBAND WITH TWO LEGS

CROSS REFERENCE TO RELATED APPLICATIONS

This application is a U.S. National Phase Application of PCT International Application Number PCT/SE2015/050741, filed on Jun. 25, 2015, designating the United States of America and published in the English language, which claims the benefit of priority to Sweden Patent Application Number SE1450952-5, filed on Aug. 15, 2014. The disclosures of the above-referenced applications are hereby expressly incorporated by reference in their entireties.

TECHNICAL FIELD

The present invention relates to ear gear, such as headphones, headset, ear protection or similar.

TECHNICAL BACKGROUND

Ear gear such as headphones, headsets or ear protection are well known on the market. For instance, one kind of ear gear are typical headphones that comprises two (one left and one right) ear cups in which the sound generating speaker elements are located. Between the ear cups and the users head there are normally ear cushion rings or pads which seals the sound in and makes it comfortable towards the head or ear. The two ear cups are often connected with a headband. The headband or the area where the headband meets the ear cups does often comprise a size adjustment function. The headband also typically comprise a folding mechanism to make the headphone smaller when stored away. To handle different head sizes and individual dimensions, angels and shapes most headsets/headphones have a rotation axis (see FIG. 1A; reference character A). Some headphones also have a rotation axis (see FIG. 1A; reference character B) in order to handle the left and right position of the ear cups (hereinafter called L/R) and individual variations. Urbanears Zinken® is one example of headphones on the market provided with a hinge that facilitates a rotation axis the ear cups for the L/R angles which is relatively large, at least 20-30 degrees on each side. However some headsets/headphones do not have an axis rotation function to handle L/R and individual variations, but a build in fixed angel to handle the L/R angles, generally around 10-30 degrees on each side.

When designing ear gear, such as headsets or headphones, the ergonomics is important, for user comfort, especially for extended period of listening, but also in order to achieve proper sound quality. There is a challenge in designing a headset/headphone with good ergonomics. There are many individual variables, for example head dimensions. Further, there are individual shapes and angles of the ear. At the same time a slim look on the head is often desired from a design perspective.

The same problem regarding improper ergonomics as mentioned above exists with ear protection of the kind comprising two ear cups that are connected with a headband.

In order for the ear gear to stay on the head and to seal the sound with a certain pressure, also called clamp force, against the ear or the head around the ear is required. Leakage may result in less bass and changed acoustic properties. A proper seal can be achieved by having a high clamp force. Another purpose/effect of a proper seal is to reduce noise form outside. However, too high clamp force can be painful for the user. Another way to get a good seal is to have a big and flexible ear-cushion, however the good foam materials tend to be rather expensive and it is often desired to keep the size of the ear gear down in order to look nice on the head. Another aspect of getting a good seal and comfortable fit is to get the headphone to adopt to the size and shape of the head and ear of the person using it. Two ways of providing a good seal and comfortable fit, the ear-cushion is either designed to be arranged on-ear or over-ear. On-ear means that the ear-cushion is small enough to be placed in direct contact on the outer ear, that is on the external part of the ear. Over-ear means that the ear-cushion is large enough to be placed over and around the outer ear, directly towards the head.

Ear gear such as headphones, headsets or ear protection can be arranged on the head such that a vertical axis of the ear cups (see FIG. 1A; reference character HV) are positioned such that the vertical axis of the ear cups are parallel on the head, if it suits the user. However, most people has the ears angled slightly downward which means the ear gear cups cannot usually be parallel in the vertical direction of the head (see FIG. 1B; reference character V), but angled somewhat downward (see FIG. 1B; reference character A) hereinafter mentioned as A-axis rotation. Further, a horizontal axis of the ear gear cups (see FIG. 1A; reference character HH) can usually not be horizontally parallel but rather angled 10-20 degrees forwards (see FIG. 1B; reference character B), hereinafter mentioned as B-axis rotation. The reason is that most people has the ears facing a bit forward, which means that the horizontal axis of the ear gear cups are not usually parallel in the horizontal direction of the head (see FIG. 1B; reference character H). This varies between different individuals. A problem with a build in fixed angle is that it does not fit all people that good. Another problem with built in L/R angle is that the ear gear must be placed correctly on the head in order to fit good. Many people wear the ear gear with the left ear cup on their right ear and vice versa which results in less good fit.

When there is no need to protect oneself against noise with the ear protection or when not listening to the headset or headphone, it is common to keep it around the neck. If there is no B-axis rotation the ear cups of the protection, headsets or headphones might be a bit uncomfortable to wear this way and they might also interfere with the users cheek when turning the head/neck.

U.S. Pat. No. 3,796,841 discloses a headset having a headband with sliding members consisting of two long fingers, which are rotatably arranged in a common pivot in a side arm that supports an ear phone/microphone. The sliding members slide in slots in the front and end edges of the headband.

SUMMARY OF THE INVENTION

It is a general object to eliminate drawbacks with prior art ear gears, such as a headphones, headsets, or ear protection.

It is desired to make a comfortable construction both from a design, usability and durability perspective and the innovation solves this in a cost efficient way.

There is a need for a piece of ear gear that can provide improved ergonomics.

An additional object is to find ear gear that result in a cost efficient manufacturing.

An additional object is to find ear gear that has the B axis rotation for good ergonomics but still with a slim design and a rotation function that does not break the design surfaces when rotating.

The purpose of the present invention relates to ear gear defined in the introduction. The ear gear is characterized by the features of the characterizing part of claim 1.

The purpose of the present invention relates to ear gear having a pair of earpieces, being attached generally to a respective end region of an interconnecting headband. Each earpiece is adjustably associated with the headband, for adjustment of the position of the earpieces relative to the headband. The ear gear further comprising at least two extending legs provided at the end region at the headband, and arm members that at one end are attached to a respective earpiece. An end cap is provided at the respective headband end region, where at least one of the extended legs is rotatably arranged to each end cap, such that the end cap can rotate relative to the at least one leg.

This has the effect that a B-axis rotation is not just limited to around a few degrees needed to achieve a good fit on the head, but to have a suitable rotation of at least 30 degrees, preferably up to about 90 degrees, on each side in order to get the ear cups laying flat on the users upper part of the chest, at the front of the neck below the jaw, when kept around the neck. Further, another benefit with an extended B-axis rotation, especially when essentially the whole headband is flexible, is that the headphones gets more durable, it can better absorb things like being dropped accidently, being stored away in a bag or being squeezed in different ways. In addition, the headphones according to the present invention provides a flexible construction both from a design, usability and durability perspective and the innovation solves this in a cost efficient way.

Consequently, at least one of the legs is rotatably arranged to the end cap. As a result, according to the invention, the end cap can rotate around the centre axis of respective leg and the legs may flex inward/outward individually. These two combined functions, provides the desired functionality according to the invention.

According to one aspect of the invention, the at least one of the extended legs is displaceable in the longitudinal direction of the at least one leg at each end cap, such that at least one leg is free to move back and forth in the longitudinal direction within each end cap. This has the effect that the rotation of the end cap in relation to the at least one leg can be more flexible.

According to a further aspect of the invention, each end cap has recesses. Each of the legs is inserted in the recesses. This has the advantage that a design efficient solution is possible that facilitate the flexible construction according to the invention.

According to yet a further aspect of the invention, the end region of the leg that is arranged in the recess within the end cap is provided with a stop member, such that the end of the leg is restricted from leaving the recess. This has the advantage that a constructional efficient solution is possible that facilitate the flexible construction according to the invention.

According to one aspect of the invention, the recess is provided with an enlarged space adjacent the position of the stop member on the leg. This is advantageous from a production and cost efficient view.

According to yet a further aspect of the invention one or more bridging elements are arranged to engage the legs of the headband along at least at one section between the end regions. This has the effect that it is possible to limit the headband twist rotation in order to avoid over-rotation of the legs of the headband.

According to one aspect of the invention the extended legs are formed by at least two wires, the wires are running essentially parallel between a respective headband end region. This has the effect that it is possible to provide the headband with excellent flexible properties.

According to a further aspect of the invention, at least one end cap has a channel for managing a cable. This has the effect that the cable will be sufficiently supported such that any breakage of the cable can be avoided.

According to a further aspect of the invention, the ear gear further comprises earpiece hinges each being supported at the respective headband end region and each having: a hinge body with at least one continuous through-bore that extends through the hinge body for receiving a respective arm member for longitudinal displacement in the through-bore. This has the advantage that the ear gear can have foldable earpieces.

According to a further aspect of the invention, the end-cap has an axis for engagement with the earpiece hinge and for providing a rotational connection with the hinge body. This has the effect that the construction can be produced with fewer components.

BRIEF DESCRIPTION OF FIGURES

Preferred embodiments of the invention will be further described with reference to the accompanying drawings.

DETAILED DESCRIPTION OF THE INVENTION

Herein embodiments of the invention will be described in detail with reference to the appended drawings. For clarity the drawings are not made to scale.

References made in the patent claims are not meant to be viewed upon as a restriction to the scope of the claims but only to make the invention easier to understand.

As will be perceived the invention can be modified in various obvious ways without derailing from the scope of the claims. Thus the drawings should be viewed upon as illustrative in their nature and not restrictive.

Figure 1A:
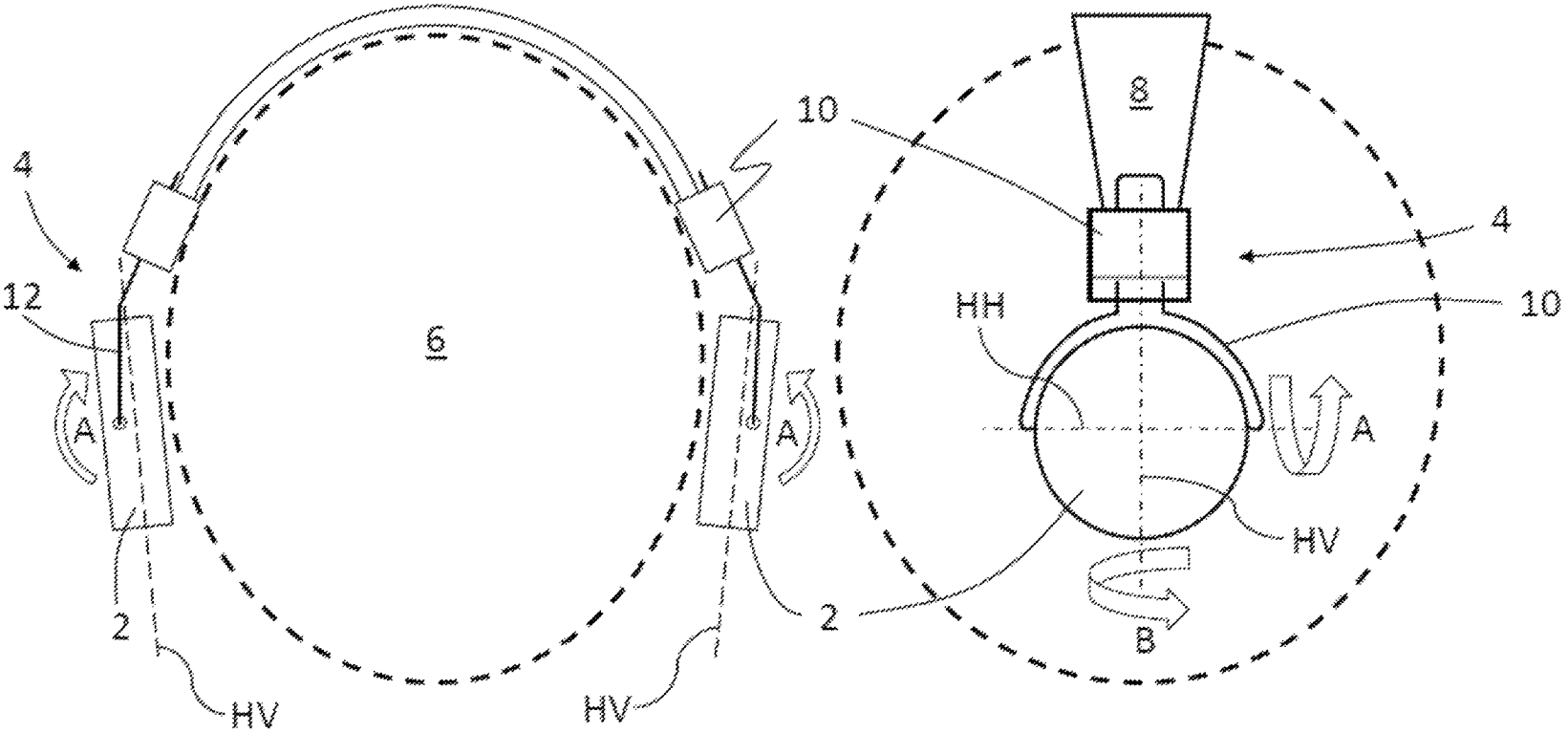
FIG. 1A schematically shows a principle for adjustability of ear cups on a human head according to the prior art.

In FIG. 1A is shown a prior art principle for adjustability of ear cups 2 of a headphone assembly 4 (hereinafter also mentioned as headphone/headphones) on a human head 6. The left illustration in FIG. 1A shows a schematic human head 6, as seen from the front or the rear, wearing headphones. The illustration to the right in FIG. 1A is a view straight from the side of the same head 6 as shown in the left illustration. A typical headphone assembly 4 comprises two (one left and one right) ear cups 2 in which sound generating speaker elements are located (not shown in FIG. 1A). Between the ear cups 2 and the users head 6 there is normally ear cushion rings or pads which seals the sound in and makes it comfortable on the head or ear. The two ear cups 2 are often connected with a headband 8. The headband 8 or the area where the headband meets the ear cups 2 does often comprise a size adjustment function 10. The headband 8 also typically comprises a folding mechanism 12 to make the headphone 4 smaller when stored away. To handle different head sizes and individual dimensions most headphones 4 has a rotation axis A. Some headphones 4 also have a rotation axis B in order to handle the left and right position of the ear cups 2 (hereinafter called L/R) and individual variations. However some headphones 4 do not have an axis rotation function to handle L/R and individual variations, but a build in fixed angel to handle the L/R angles, generally around 10-20 degrees on each side.

Figure 1B:
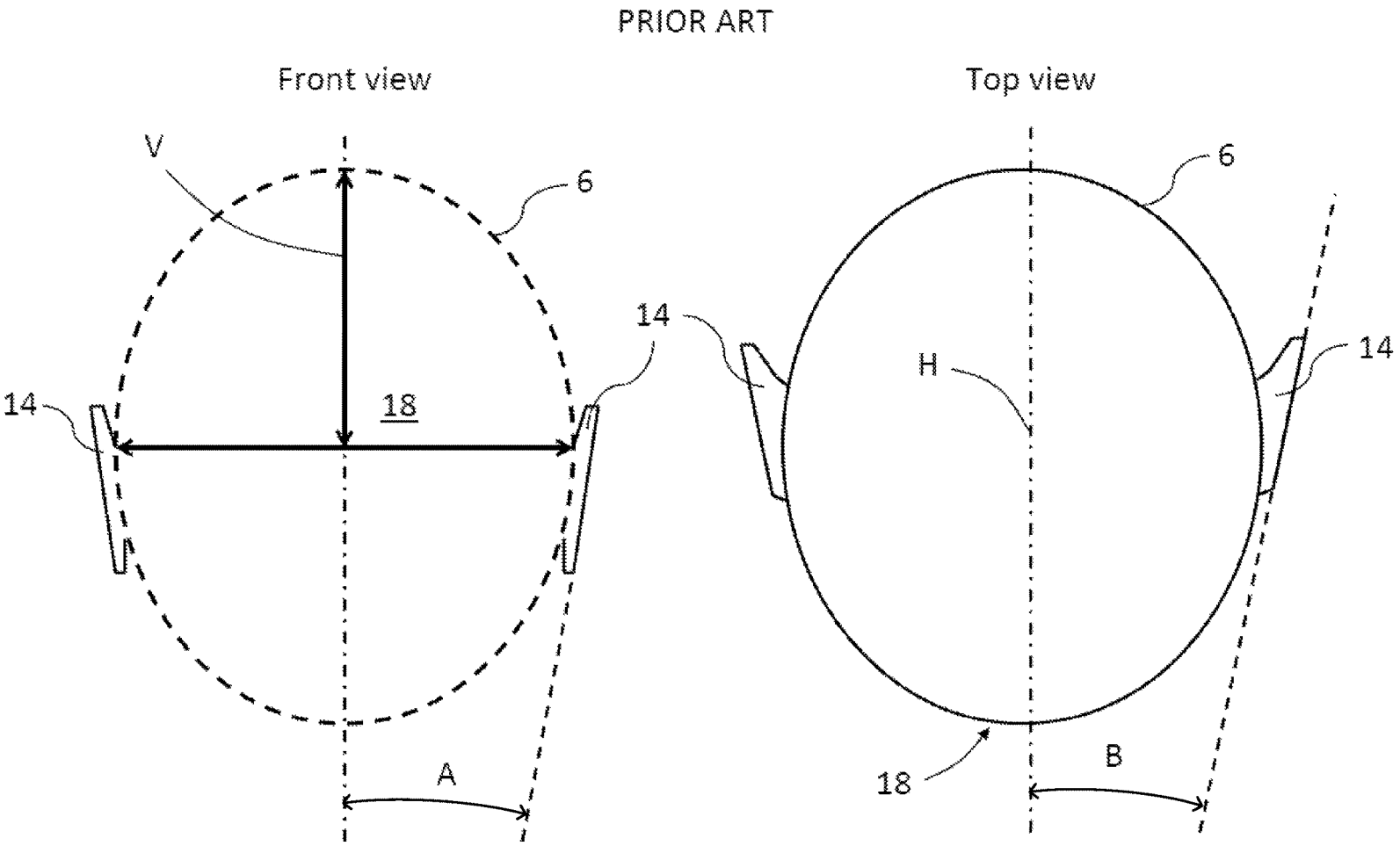
FIG. 1B illustrates schematically the inclination of the ears on a human head in a front view to the left and a top view to the right according to the prior art.

In FIG. 1B the inclination of the ears 14 on the human head 6 according to common knowledge is generally shown. In the illustration to the left the head 6 is shown in a front view, towards the face 18. In the illustration to the right a top view of the head 6 is shown, where the face 18 is positioned downwards. Most people have the ears 14 angled slightly downwards, which means the ear cups 2 cannot usually be parallel in the vertical direction V, but angled somewhat downward (see reference character A) hereinafter mentioned as A-axis rotation. Further, a horizontal axis of the ear cups 2 cannot usually be horizontally H parallel but rather angled 10-20 degrees forward (see reference character B), hereinafter mentioned as B-axis rotation. The reason is that most people has the ears facing a bit forward, which means the ear gear cups are not usually parallel in the horizontal direction H of the head. This varies between different individuals. A problem with a build in fixed angle is that it does not fit all people very good. A problem with a built in L/R angle is that the headphone 4 must be placed correctly on the head in order to fit well. Many people put the headphones 4 on with the left ear cup on their right ear and vice versa which results in less good fit.

The present technology will now be explained with reference to exemplifying embodiments of headphones. These embodiments of the technology relate to an application of the inventive solution to an headphone of general design. However, the present technology is equally well suited for application to other types of headphones as well as ear gear such as headsets or ear protection of varying design. It is therefore emphasized that the illustrations are for the sole purpose of describing preferred embodiments and are not intended to limit the invention to details or to any specific field of application thereof.

Figure 2:
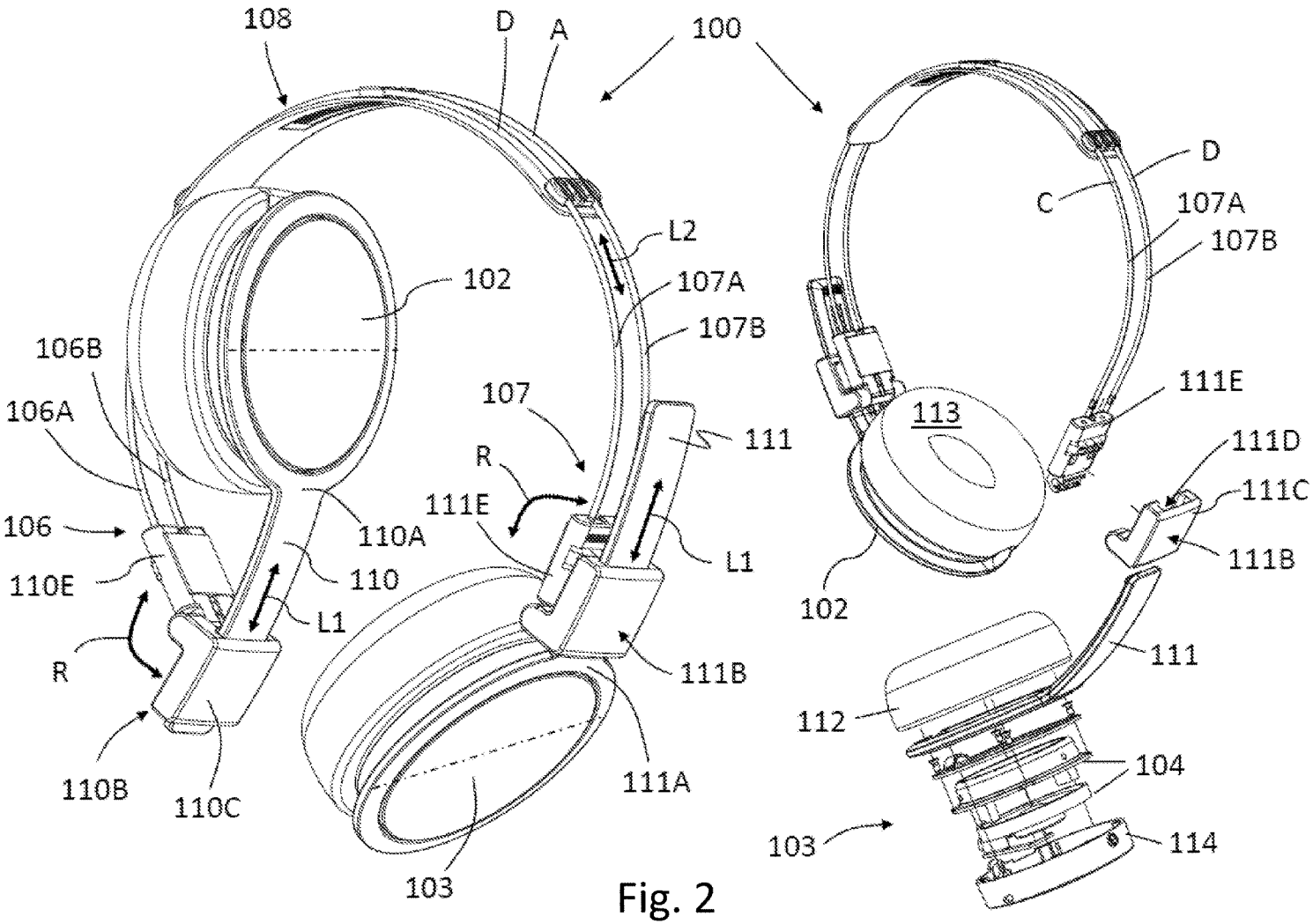
FIG. 2 shows a perspective view of a headphone assembly according to a first embodiment of the present invention.

In FIG. 2 is shown an example of ear gear according to a first embodiment, in this example a headphone assembly 100. The headphone assembly 100 having a pair of earpieces 102, 103 each with associated speaker units 104, being attached generally to a respective end region 106, 107 of an interconnecting headband 108. Each earpiece 102, 103 are adjustably associated with the headband 108, for adjustment of the position of the earpieces 102, 103 relative to the headband 108. Further, the end regions 106, 107 of the headband 108 are provided with at least two extending legs 106A, 106B and 107A, 107B, respectively. As shown in FIG. 2, the headphone assembly 100 may further comprise arm members 110, 111 that at one end 110A, 111A are attached or integrated in one piece with a respective earpiece 102, 103. Although not shown in FIG. 2, the arm members 110, 111 can be formed as wire loops. As shown in this example in FIG. 2, the headphone assembly 100 may further comprise earpiece hinges 110B, 111B, each being supported at the respective headband end region 106, 107 and each having a hinge body 110C, 111C with a continuous through-bore 111D (only shown at hinge body 111C) that extends through the hinge body 111C for receiving a respective arm member 110, 111 for longitudinal displacement L1 in the through-bore 111D. As an alternative the arm member can be made of at least two substantially parallel wires which are formed into a loop, and the wires are movably arranged in substantially parallel throughbores in the hinge bodies 110C, 111C. Each hinge body 110C, 111C can be rotatably R connected to an end cap 110E, 111E at the respective headband end region 106, 107. In the end cap 110E, 111E, at least one of the extended legs 106A, 106B and 107A, 107B, respectively, is freely arranged, in such a way that at least one leg 106A, 106 B and 107A, 107B, is rotatably arranged to the end cap such that the end cap can rotate relative the at least one leg 106A, 106B, 107A, 107B. Suitably, at least one leg may also be displaceably arranged such that the leg is free to move back and forth in the longitudinal direction L2 of the at least one leg within the end cap 110E, 111E. This is further described below with reference to FIGS. 4-5.

Consequently, ear gear as the exemplified headphone assembly in FIG. 2 is accomplished in such a way that the headband on each side has two legs 106A, 106B and 107A, 107B, respectively which are connected to each end cap 110E, 111E, such that at least one of the legs 106A, 106B and 107A, 107B, respectively, of each end cap can rotate and suitably move slightly up and down in the longitudinal direction L2 of the at least one leg. This facilitates a flexibility of the legs as well as making it possible for the end caps to rotate around each axis of the holes of the corresponding legs. This makes the L/R (B-axis rotation) possible in a slim and integrated way. Preferably, both two legs are freely arranged to the end cap 110E, 111E, such that the end of the legs 106A, 106B and 107A, 107B, respectively, can rotate and suitably move slightly up and down L2 individually.

The legs 106A, 106 B, 107A and 107B, suitably comprise of thin and elongated members with certain rigidity and bending resistance, such as wires, strings, threads, or similar, made of metal, composite materials, polymer or the like. According to a preferred embodiment, the extended legs are formed by at least two wires.

The legs 106A, 106B, 107A and 107B are suitably running essentially parallel and along the whole distance between the respective headband end region 106, 107. Hence, the two respective legs 106A, 107A at the end regions of the headband 108 are forming a first elongated leg C extending from one end cap 110E to the other 111E. The two other respective legs 106B, 107B at the adjacent end regions are forming a second elongated leg D extending from one end cap 110E to the other 111E.

In the example of the headphone assembly in FIG. 2 it is also shown that the earpieces 102, 103, each with associated speaker units 104, are provided with an ear cushion 112, 113 to be positioned close to the ear of the user. On the opposite side to the ear cushion 112, 113 of each of the earpieces 102, 103, there is a cover plate 114. Between the cover plate 114 and the ear cushion 112 is among other things the speaker unit 104 arranged and other constructional components for attaching the parts of the ear pieces 102, 103 together.

Figure 3:
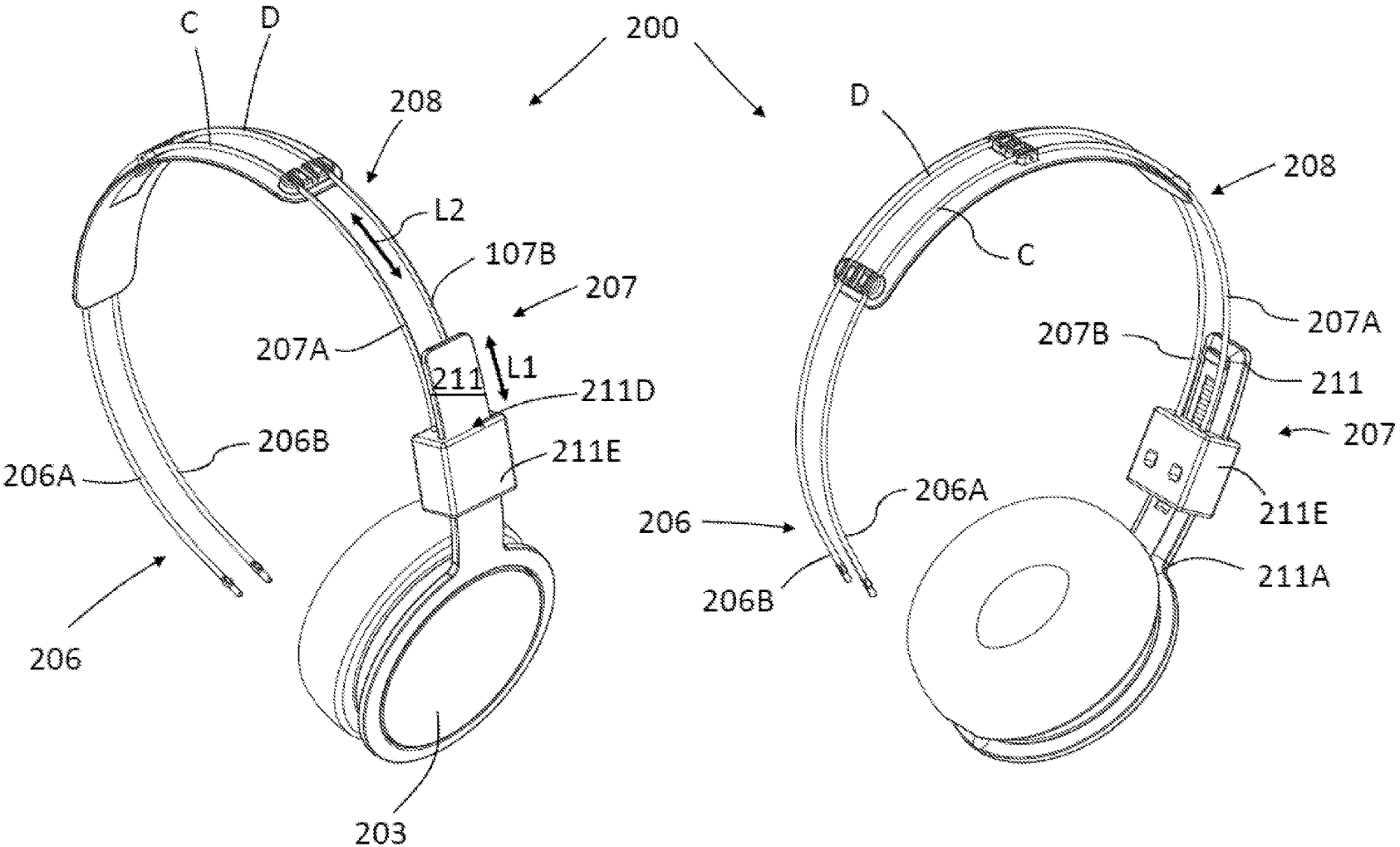
FIG. 3 shows a perspective view of a headphone assembly according to a second embodiment of the present invention.

FIG. 3 shows a perspective view of a headphone assembly 200 according to a second embodiment of the present invention. The headphone assembly 200 having a pair of earpieces 203 (only one is shown in FIG. 3) each with associated speaker units, being attached generally to a respective end region 206, 207 of an interconnecting headband 208. Each earpiece 203 is adjustably associated with the headband 208, for adjustment of the position of the earpieces 203 relative to the headband 208. Further, the end regions 206, 207 of the headband 208 are provided with at least two extending legs 206A, 206 B and 207A, 207B, respectively. As shown in FIG. 3, the headphone assembly 200 may further comprise arm members 211 (only one is shown at earpiece 203) that at one end 211A is attached or integrated in one piece with a respective earpiece 203. Although not shown in FIG. 3, the arm members 211 can be formed as wire loops. As shown in this example in FIG. 3, the headphone assembly 200 does not comprise earpiece hinges at the respective headband end region 206, 207. Instead a continuous through-bore 211D that extends through an end cap 211E (again only one is shown at earpiece 203) receives a respective arm member 211 for longitudinal displacement L1 in the through-bore 211D. Since there is no hinge or hinge members that connect the ear cups 203 with the end cap 211E, the ear cups 203 are not foldable. In the end caps 211E, at least one of the extended legs 206A, 206 B and 207A, 207B, respectively, is rotatably arranged to the end cap in such a way that the end cap can rotate relative the at least one leg 206A, 206B, 207A, 207B. Suitably, at least one leg may also be displaceably arranged such that the leg is freely arranged, so at least one leg 206A, 206 B and 207A, 207B, is free to move back and forth in the longitudinal direction L2 of the at least one leg within the end cap 211E. This is further described below with reference to FIGS. 4-5.

Consequently, ear gear as the exemplified headphone assembly in FIG. 3 is accomplished where the headband on each side has two legs 206A, 206B and 207A, 207B, respectively which are connected to each end cap 211E (again only one is shown at earpiece 203), in such a way that at least one of the legs 206A, 206B and 207A, 207B, respectively, of each end cap can rotate and suitably move slightly up and down in the longitudinal direction L2 of the at least one leg. This facilitates a flexibility of the legs that also make it possible for the end caps to rotate around each axis of the holes of the corresponding legs. This makes the L/R (B-axis rotation) possible in a slim and integrated way. Preferably, both two legs are freely arranged to the end cap 211E, such that the end of the legs 206A, 206B and 207A, 207B, respectively, can rotate and suitably move slightly up and down L2 individually.

The legs 206A, 206B and 207A, 207B, respectively, suitably comprise of thin and elongated members with certain rigidity and bending resistance, such as wires, strings, threads, or similar, made of metal, composite materials, polymer or the like. According to a preferred embodiment, the extended legs are formed by at least two wires.

The legs 206A, 206B and 207A, 207B, respectively, are suitably running essentially parallel and along the whole distance between the respective headband end regions 206, 207. Hence, the two respective legs 206A, 207A at the end regions 206, 207 of the headband 208 is forming a first elongated leg C extending from one end cap (not shown) at the end region 206 to the other end cap 211E at end region 207. The two other respective legs 206B, 207B at the adjacent end regions 206, 207 is forming a second elongated leg D extending from one end cap (not shown) at the end region 206 to the other end cap 211E at end region 207.

Figures 4A, 4B, 4C:
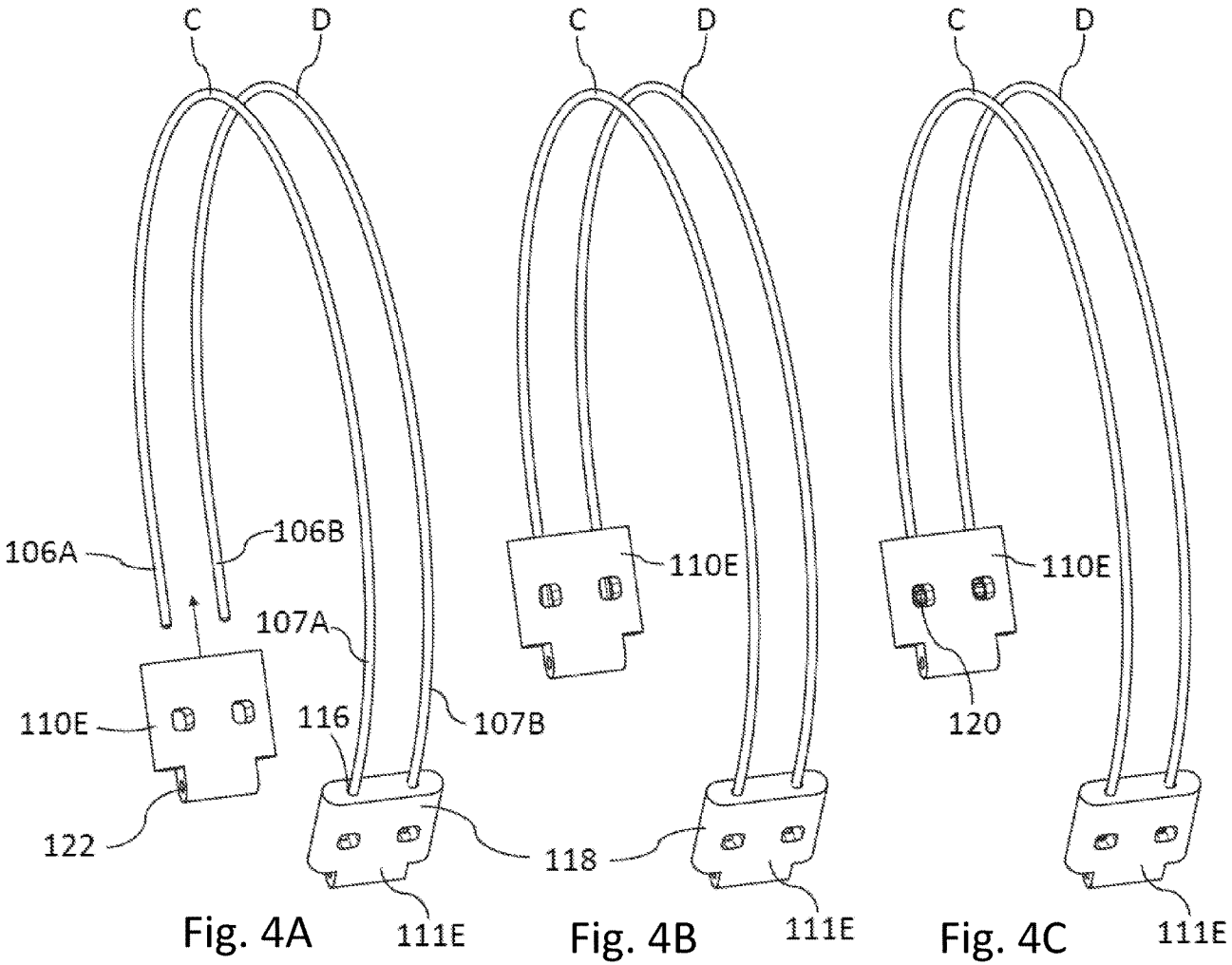
FIG. 4A-C shows perspective views of the extended legs forming the headband of a headphone assembly according to a third embodiment of the present invention.

In FIGS. 4A, 4B and 4C the legs forming the headband of a headphone assembly of the kind shown in FIG. 2 above are shown, according to a third embodiment. According to the embodiment described and shown in FIGS. 4A, 4B and 4C, the same reference numbers as in the embodiment of FIG. 2 have been used for the similar features. Each end cap 110E, 111E have recesses in the form of elongated holes 116 (see also FIG. 5D described below) and where each of the legs are inserted in the holes 116. Suitably, the holes are blind holes 116 (also called dead end holes). As shown in FIG. 4A-B, each side of the legs 106A, 106B and 107A, 107B, respectively, of the headband are inserted in the end-caps 110E, 111E. As seen from FIGS. 4A, 4B and 4C, the side surface of the end cap may comprise windows 118 that have access from the side to the interior of the hole 116 and an inserted leg 106A, 106B and 107A, 107B, respectively, in the hole. The end regions 106, 107 of the legs are provided with stop members 120. It is possible to provide the leg with the stop member 120 (see also FIGS. 5B and 5D described below), or make a deformation to the leg with a press tool while the leg is within the hole. According to one embodiment the legs 106A, 106B, 107A and 107B, can be deformed by a press tool, forming a stop member 120, to lock them from slide back out from the holes 116 in the end cap 110E, 111E. In FIG. 4C, deformed legs forming a respective stop member 120 on each leg is shown in the windows 118 in the side of the end cap 110E, 111E. Consequently, it is the end part of the leg 106A, 106B,107A, and 107B, that is arranged in the hole 116 within the end cap and that is provided with the stop member, in such a way that the end of the leg is restricted from leaving the hole 116. It is an advantageous and cost efficient way to make the stop mechanism by deforming legs made of metal wires. However, the stop member 120 could be made in other ways as well, for instance by pressing on a metal tube or by moulding on a plastic part, etc. Hence, the stop member 120 can be a separate part that is attached to the leg when inserted in the hole 116. It is also possible according to an embodiment that the leg is extending through the end cap 110E, 111E, in a through hole in the end cap, such that the end of the leg is protruding from the bottom side of the end cap. Then the stop member 120 is arranged on the end that protrudes from the bottom side of the end cap. According to one aspect of the invention, the hole 116 is provided with an enlarged space 121 adjacent the position of the stop member 120 on the leg. Hence, the entrance diameter of the hole at a side of the end cap can be slightly larger than the diameter of the leg, while the hole 116 becomes enlarged towards the other side of the end cap (see also FIG. 5D), such that the end region 106, 107 of the leg with the stop member 120 is free to move back and forth in the longitudinal direction in the enlarged space 121 of the hole 116 within end cap. The enlarged space may extend along a major part of the hole in such a way that the leg can slide a considerable distance within the hole 116. It is also possible that the enlarged space 121 only extend along a short part of the hole such that the leg may have a delimited displacement within the hole 116.

As a further alternative, the stop member 120 can be attached to the leg before inserted into the hole 116, but this requires that the hole is sufficiently wide when the leg 106A, 106B, 107A, and 107B, is inserted into the hole and that the entrance diameter of the hole is made smaller after the leg with the stop member 120 has been inserted into the hole 116.

In the shown example according to FIGS. 4A, 4B and 4C, both legs 106A, 106B and 107A, 107B, respectively, at each end cap 110E, 111E, are illustrated as being freely movable within the holes 116. However, within the broadest scope of protection of the present invention, one of the legs 106A, 106B and 107A, 107B, respectively, to each end cap 110E, 111E, can be freely arranged to move up and down within the end cap, while the other(s) can be firmly attached to or within the hole 116 in the end cap.

It is possible that the legs have different cross-section, as long as a recess in an end cap is sufficiently large such that the at least one leg may rotate smoothly within the recess of the end cap. The legs are preferably essentially circular in cross-section such that the end-cap recesses can rotate smoothly around the legs, such that the legs can flex in and out individually in a sufficient manner.

The end cap 110E, 111E is ideally made as one part in order to get it strong, slim and cheap, however the tooling for producing that part is quite complex. The end cap could be made with a more simple tool if it is split into two parts. Hence, the manufacturing of the end cap is not limited to that the end cap is made out of just one part. It could be made out of several parts that are fixed together. In that case it is easy to provide the stop member 120 to each leg, then arranged each leg within one of the end cap parts before fixing them together.

In all these FIGS. 4A-C, the end-cap has a horizontal hole 122 for folding axis of the earpiece hinges according to the embodiment described in FIG. 2. It can be arranged in other various ways.

Figures 5A, 5B, 5C, 5D:
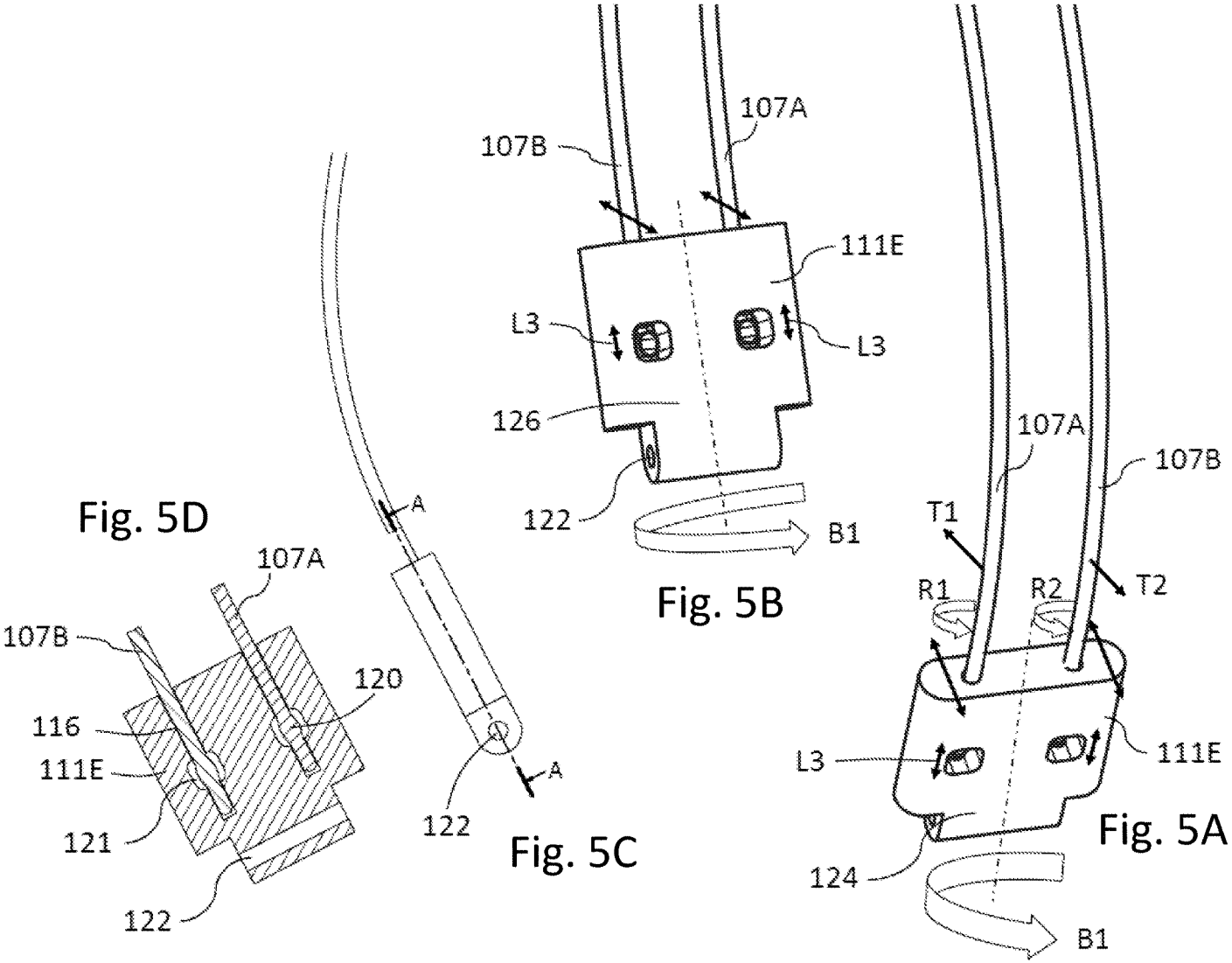
FIG. 5A-D shows in enlarged views the ends of the extended legs of the headband, in a perspective view in FIGS. 5A-B, one end cap in a side view in FIG. 5C, as well as the end cap in a cross section view in FIG. 5D, according to a forth embodiment of the present invention.

FIG. 5A-D shows in enlarged views the ends of the extended legs 106A, 106B and 107A, 107B, respectively, arranged in the end cap of the headband, in a perspective view in FIGS. 5A-B, according to a forth embodiment of the present invention, where FIG. 5A shows the outer side 124 of the end cap 111E and FIG. 5B shows the opposite inner side 126 of the end cap 111E. Further, the end cap 111E in a side view in FIG. 5C, as well as the end cap in a cross section view in FIG. 5D along line A-A in FIG. 5C, according to the forth embodiment. According to the embodiment described and shown in FIGS. 5A, 5B, 5C and 5D, the same reference numbers as in the embodiment of FIGS. 2, 4A, 4B and 4C, have been used for the similar features. As illustrated in FIGS. 5A-B, the legs are freely rotatable R1, R2 and suitably also movable longitudinally L3 within a portion of the holes. Suitably, at least one leg has a restricted vertical freedom of movement in longitudinal direction L3. Consequently, this means that the legs can flex in and out individually. With other words, this also results in that the end cap can rotate smoothly around the legs. However, as mentioned above, the solution is not restricted to that both legs are freely arranged in the end caps. Thus, a further consequence is that if the end cap is turned in the direction of the arrow B1 in FIG. 5A, one of the legs, a first leg 107A, will turn T1 more inwardly than the other adjacent leg, a second leg 107B, in the end cap, taking a position T2 behind the first leg 107A, such that the extension of the legs 107A, 107B are no longer parallel arranged along the headband. Hence the legs will flex in the direction as shown by the arrows L3, T1, T2. Even if it is only one of the legs 106A, 106B and 107A, 107B, respectively, that is rotatably arranged and suitably also freely arranged to move within part of the hole in one end cap, while the other leg or wire is firmly attached in the end cap, the same function can be achieved. However, the flexibility and function is more smooth and powerful when both legs 106A, 106 B and 107A, 107B, respectively, are rotatably arranged and suitably also freely arranged to move within portions of the holes 116 in one end cap. In FIG. 5D stop members 120 of the legs 107A, 107B shown in the figure which have been provided by a deformation of the leg 107A, 107B with a press tool. It is also shown that the end cap has a horizontal through hole 122 for a folding axis for a preferred hinge body as mentioned above in connection to the description of the embodiment in FIG. 2. However, the folding axis for the hinge bodies 110C, 111C may be formed by two pins extending from each hinge body 110C, 111C which snaps into the hole 122 of each end cap 110E, 111E. Then, the hole 122 do not have to extend all way through the end caps 110E, 111E. Instead, two holes 122 from each side of the end caps 110E, 111E may be formed. As an alternative the pins may be arranged on the end caps 110E, 111E, and the holes may be arranged on the hinge bodies 110C, 111C.

The result is a headband 108 with build-in twist function. However this construction is quite easy to over-rotate, such that the legs 106A, 106B, 107A, and 107B, forming the headband 108 may flip inside out. Therefore, some extra support may be needed according to embodiments, which are shown below in FIGS. 6A-C.

Figures 6A, 6B:
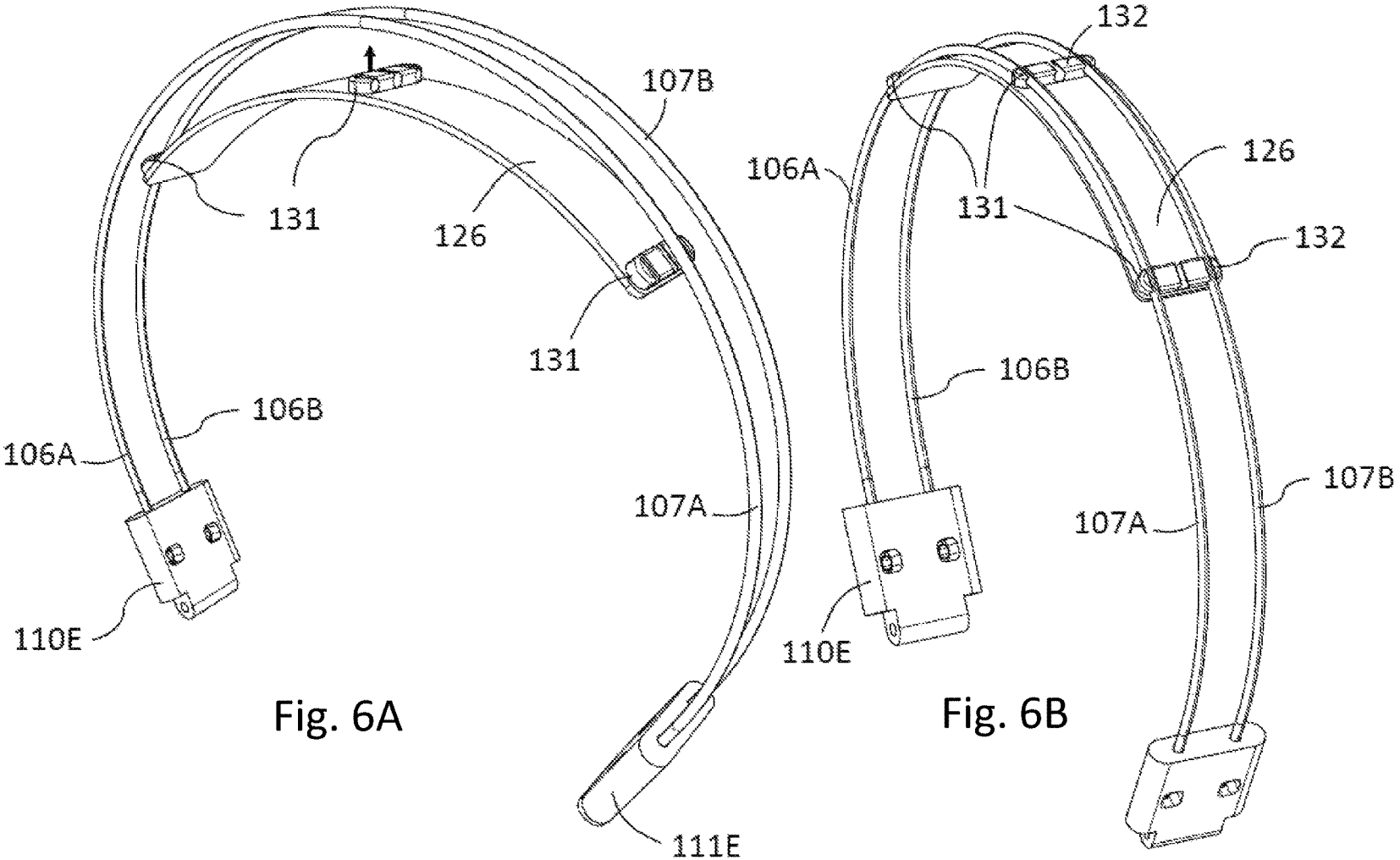
FIG. 6A-C shows perspective views of the extended legs forming the headband of a headphone assembly provided with one bridge in FIGS. 6A-B according to a fifth embodiment, and a sixth embodiment with two separate bridges in FIG. 6C, of the present invention.
Figure 6C:
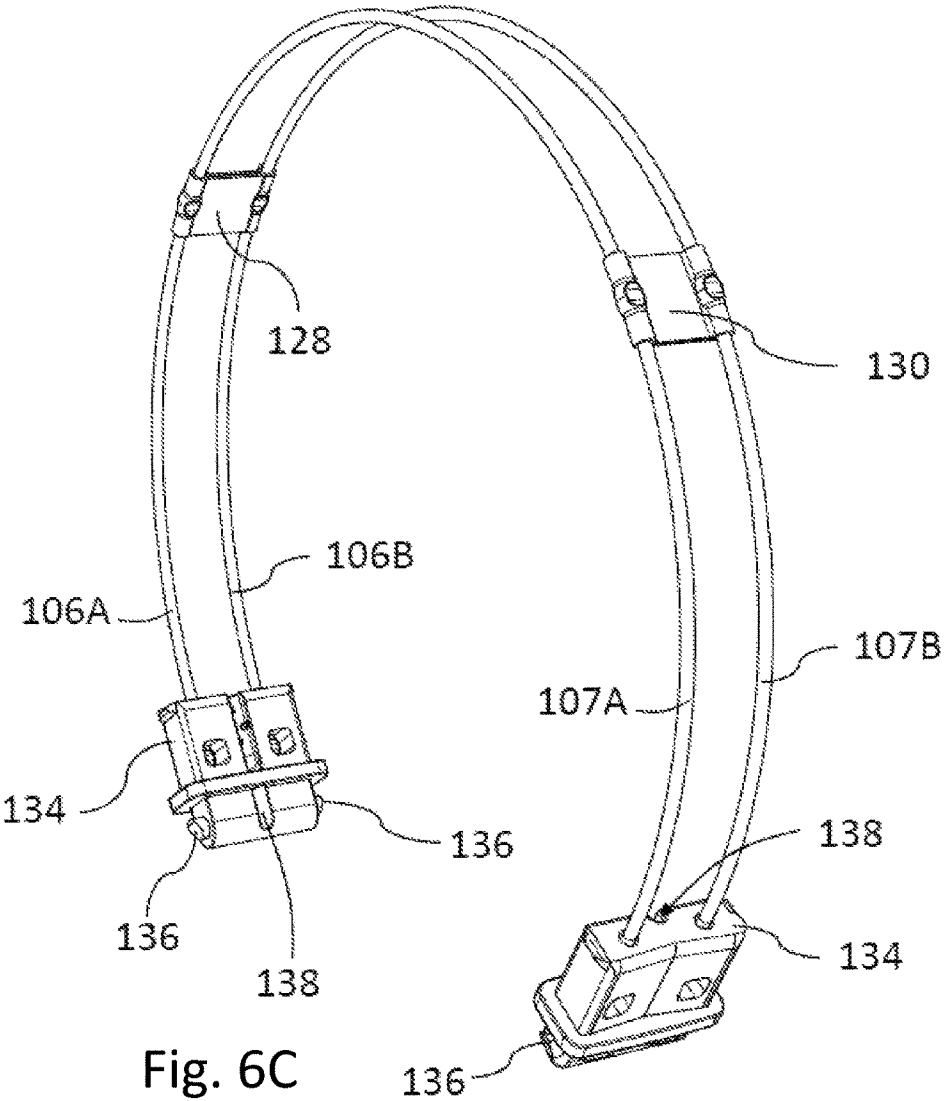

FIG. 6A-C shows perspective views of the elongated, extended legs 106A, 106B, 107A, and 107B, forming the headband of a headphone assembly provided with an extra support in the form of one bridge 126 in FIGS. 6A-B according to a fifth embodiment, and in a sixth embodiment with two separate bridges 128, 130 in FIG. 6C, of the present invention.

According to the embodiments described and shown in FIGS. 6A, 6B and 6C, the same reference numbers as in the embodiment of FIGS. 2, 4A-C and 5A-D have been used for the similar features.

The headbands in FIGS. 6A-C with one or more headband bridge(s) 126, 128, 130 are arranged to limit the headband twist rotation, or over-rotation, and to support a cable (not shown). The at least one headband bridge 126, 128, 130 is intended to connect and support two or more legs. The length and stiffness of the bridge 126, 128, 130 affect the twist freedom of the headband. The headband bridge or bridges 126, 128, 130 could for instance be made out of e.g. metal and pressed on the headband legs or made out of e.g. plastic and snapped onto the headband legs as shown in FIGS. 6A-B. In the embodiment of FIG. 6 C it is shown two separate bridges 126, 128, 130. that can be attached by deforming the metal by a common method.

The bridge shown in FIG. 6A-B comprises sections 131 with a channel 132 in the middle for holding a cable (not shown). Another difference is that in FIG. 6C, the end cap 134 may have pins 136 pointing out from the end cap forming an axis for engagement with the earpiece hinge and for providing a rotational connection with the hinge body. The hinge body is connected by snapping it onto the end cap. The end cap 110E, 111E as shown in FIGS. 6A-B has holes 122 in the end cap to achieve the same function. The end cap may also have a channel 138 for managing a cable (not shown) which is shown in FIG. 6C.

The headband may suitably have a covering. The covering may be made of fabric, leather, vinyl, foam, padding, and the covering can be removable. The purpose of the covering is to cover the legs 106A, 106B, 107A, and 107B, such that the ear gear is more comfortable to wear on the users head.

Instead of making the headband out of two legs the same mechanism is achieved by making it out of a single sheet metal (previous prototype) which then also includes the bridge function and the end regions are pressed to a rounded shape, which creates the extended legs 106A, 106B, 107A, and 107B.

Combinations of features between different embodiments described above are possible.

The invention claimed is:

1. An ear gear comprising a pair of earpieces being attached to a respective end region of an interconnecting headband whereby each earpiece is adjustably associated with the headband, for adjustment of the position of the earpieces relative to the headband, the ear gear further comprising:

at least two extended legs provided at the end region of the headband;

arm members that at one end are attached to a respective earpiece, an end cap provided at the respective headband end region, wherein at least one of the extended legs is rotatably arranged with each end cap, such that the end cap can rotate relative to the at least one of the extended legs, and wherein each end cap has recesses and each of the extended legs are inserted in respective recesses; and at least one of the extended legs is displaceable in a longitudinal direction extending along the at least one of the extended legs at each end cap, such that the at least one of the extended legs is moveable back and forth in the longitudinal direction within the respective recess of each end cap.

2. The ear gear of claim 1, wherein an end of the extended leg that is arranged in the recess within the end cap is provided with a stop member, such that the end of the extended leg is restricted from leaving the recess.

3. The ear gear of claim 2, wherein the recess is provided with an enlarged space adjacent to a position of the stop member on the extended leg.

4. The ear gear of claim 1, wherein one or more bridging elements are arranged to engage the extended legs of the headband along at least one section between the end regions.

5. The ear gear of claim 1, wherein each of the extended legs are formed by at least two wires, the at least two wires extending essentially in parallel from a respective headband end region.

6. The ear gear of claim 1, wherein at least one end cap has a channel in which a cable extends.

7. The ear gear of claim 1, wherein the ear gear further comprises earpiece hinges each being supported at the respective headband end region and each comprising a hinge body with at least one continuous through-bore that extends in a second longitudinal direction through the hinge body for receiving a respective arm member for displacement along the second longitudinal direction in the through-bore.

8. The ear gear of claim 7, wherein the end cap comprises a hole or pin for engagement with the earpiece hinge and for providing a rotational connection with the hinge body.

9. The ear gear of claim 1, wherein the end cap comprises a continuous through-bore in a second longitudinal direction that receives the respective arm member for displacement along the second longitudinal direction in the through-bore, and wherein the end cap is made in one piece with fixed, non-rotatable parts.

* * * * *